United States Patent [19]

Logsdon

[11] 4,160,347

[45] Jul. 10, 1979

[54] ROOF FLASHING STRUCTURE

[75] Inventor: Duane D. Logsdon, Fullerton, Calif.

[73] Assignee: The Logsdon Foundation, Stanton, Calif.

[21] Appl. No.: 883,420

[22] Filed: Mar. 6, 1978

[51] Int. Cl.[2] ..... E04B 7/00

[52] U.S. Cl. ..... 52/199; 52/218; 285/42; 277/152; 277/181

[58] Field of Search ..... 52/199, 58, 219, 218; 285/42, 43, 44; 277/181, 182, 184, 152, 153

[56] References Cited

U.S. PATENT DOCUMENTS

| | | | |
|---|---|---|---|
| 2,893,770 | 7/1959 | Poncet | 277/182 |
| 3,098,663 | 7/1963 | Dibley | 285/43 |

*Primary Examiner*—Price C. Faw, Jr.
*Assistant Examiner*—Carl D. Friedman
*Attorney, Agent, or Firm*—Edward D. O'Brian

[57] ABSTRACT

To form a seal between a roof and a pipe projecting through this roof, it is known to construct roof flashing structures having a flat plate which has a centralized opening and an upstanding tapered housing attached to the flat plate and extending around said opening. Such roof flashing structures can be improved by providing the top of the housing with an annular sealing ring seat which has an external wall formed as an extension of the housing wall, an interior wall, parallel to the exterior wall, and a top wall connecting the exterior and interior walls. These three walls define a channel within the housing. The channel opens in a downward direction toward the plate and a rib on a sealing ring fits into this channel and seats the sealing ring into the sealing ring seat. The sealing ring has a groove extending circularly around its upper surface and this groove defines both the rib which fits into the sealing ring seat channel and a second inner rib which has a plurality of flanges extending circularly around this second rib. These flanges meet up against and form a seal with a pipe.

7 Claims, 4 Drawing Figures

ROOF FLASHING STRUCTURE

CROSS-REFERENCE TO RELATED PATENTS

This application is related to my prior application U.S. Pat. No. 4,010,578 which issued Mar. 8, 1977, the disclosure of which is herein incorporated by reference.

BACKGROUND OF THE INVENTION

To form a seal between a roof and a pipe projecting through this roof, it is known to construct roof flashing structures of the type having a flat plate which has a centralized opening and an upstanding tapered housing attached to the flat plate and extending around said opening. The opening between the housing and the pipe is then sealed with a calking or other mastic-like material which with time and weather will frequently crack and/or deteriorate to such an extent that it will leak.

In my U.S. Pat. No. 4,010,578 I described certain roof flashing structures which incorporate the use of a sealing ring to overcome the disadvantages of the prior flashing structures. However, even with the advantages of my prior roof flashing structures it is considered that there exists a need for a roof flashing structure of the type incorporating a sealing ring wherein said sealing ring is fixed in place in the roof flashing structure and cannot be easily disengaged from said structure and become lost during transit and storage, in addition to a roof flashing structure having a sealing ring which is held fast to the flashing structure so that when a pipe is pushed up through the sealing ring the sealing ring is maintained in its proper sealing position within the roof flashing structure and is not pushed out of the structure or the seal between the housing and the ring distorted by the action of the pipe through the ring.

SUMMARY OF THE INVENTION

From the foregoing paragraph it is believed that there is still a need for new and improved roof flashing structures. A broad object of this invention is to fulfill this need. Additional objects are to provide roof flashing structures which are easily and economically manufactured yet are durable and capable of giving long, reliable performance.

In accordance with the present invention these and other objects, features and attendant advantages are achieved by providing a roof flashing structure of the type having a generally flat plate with a centralized opening which has a larger dimension than that of the pipe which will traverse through said opening. Integrally attached to the plate and extending from the plate is a tapered housing. Both the plate and the housing are formed of a rigid material such that the housing extends upward from the plate and the centralized hole in the plate forms the lowermost opening in the housing. At the uppermost periphery of the housing is an annular sealing ring seat. This seat is formed by an exterior wall which is an extension of the housing, a top wall, and an interior wall. Together the exterior wall, top wall and interior wall define a channel within the housing which opens in a downwardly direction toward the opening in the plate. A sealing ring formed of a resilient, elastomeric material has a generally round, donut shape. Extending around the upper surface of the sealing ring is a groove which divides the upper portion of the sealing ring into an outer rib and an inner rib. The outer rib of the sealing ring fits into the channel in the sealing ring seat. The inner rib of the sealing ring has a plurality of sealing flanges extending circularly around the rib and projecting radially toward the center of the sealing ring. Each of these flanges is independently capable of engaging with and forming a seal with a pipe which will pass through the center of the sealing ring. On the interior walls of the housing proximal to the upper portion of the housing are a series of holding flanges. When the sealing ring is mated with the sealing ring seat the bottom surface of the sealing ring rests on the upper surface of the flanges and the sealing ring is retained within the sealing ring seat.

The aforedescribed advantages and objects of the present invention and other objects and advantages of the present invention will become apparent to those skilled in the art on consideration of the following detailed description of the preferred embodiments thereof with reference being made to the accompanying drawings.

Figure 1:
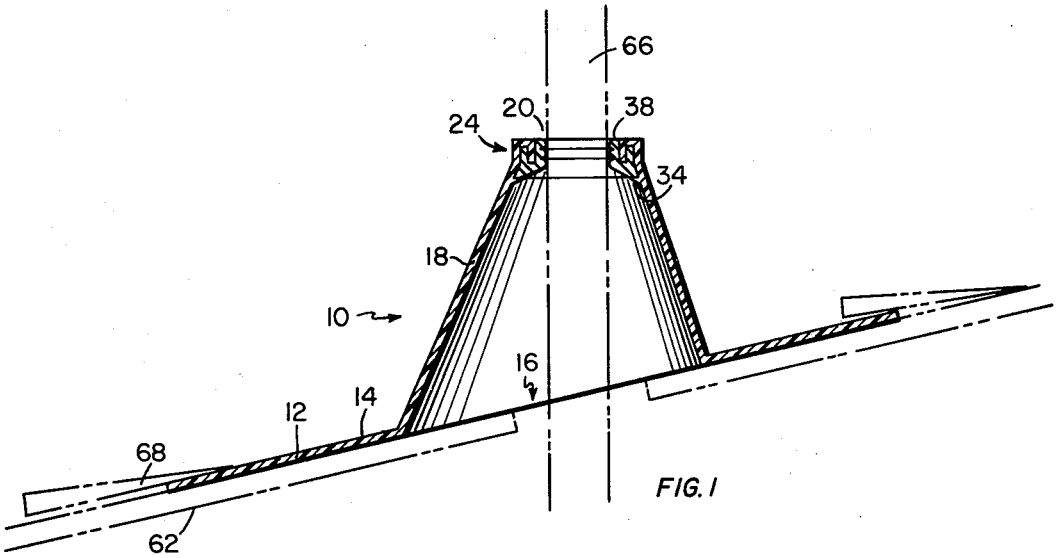
FIG. 1 is a cross-sectional view of a presently preferred embodiment of a roof flashing structure as attached to a roof and having a pipe extending therethrough.
Figure 2:
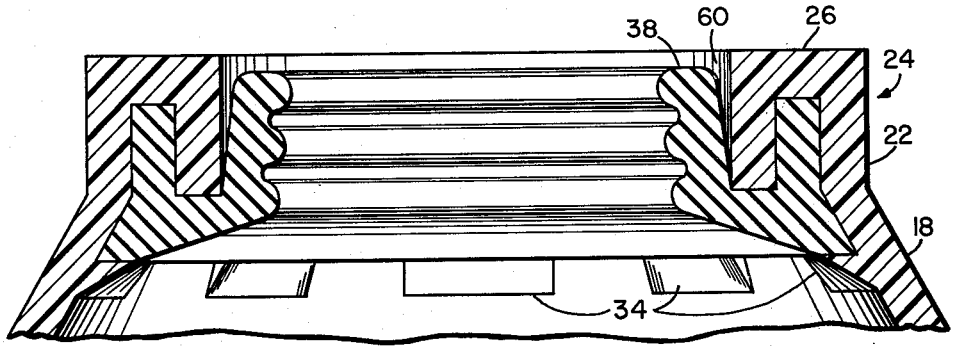
FIG. 2 is an enlarged fragmentary cross-sectional view of the uppermost portion of the roof flashing structure shown in FIG. 1.
Figure 3:
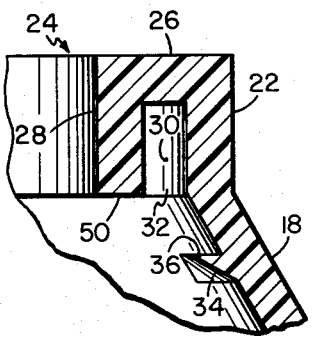
FIG. 3 is an enlarged fragmentary cross-sectional view of the housing portion of the roof flashing structure shown in FIG. 1.
Figure 4:
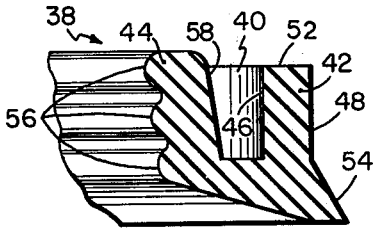
FIG. 4 is an enlarged fragmentary cross-sectional view of the sealing ring portion of the roof flashing structure shown in FIG. 4.

The roof flashing structure illustrated in the drawings is constructed so as to utilize the essentially intangible concepts of the invention set forth and defined in the appended claims. It will be realized that these concepts can be utilized within a variety of somewhat differently appearing and differently constructed structures through the use or exercise of routine design and engineering skill

DETAILED DESCRIPTION OF THE INVENTION

The roof flashing structure 10 illustrated in the accompanying drawings includes a generally flat plate 12 which is adapted to overlie and fit flat against a roof which is shown in phantom lines in FIG. 1. Shingles, also shown in phantom lines in FIG. 1, or other roofing material overlap the top side 14 of the plate 12. The plate 12 has a centrally located opening 16 and an upstanding housing 18 attached to the plate 12 around the periphery of the opening 16 so as to extend upward from the upper surface or side 14 of plate 12. This housing 18 is generally tapered shaped and has its largest dimension adjacent to the plate 12, and it terminates in an opening 20 which is remotely located from the plate 12.

The uppermost terminus of housing 18 forms the exterior wall 22 of a sealing ring seat 24. The remainder of the sealing ring seat 24 is formed by top wall 26 and interior wall 28. Together the insides of walls 22, 26 and 28 define a channel 30 extending circularly around the inside perimeter of housing 18. The open side 32 of channel 30 faces downward toward opening 16 in plate 12. Spaced around the inside perimeter and slightly below the open side 32 of channel 30 are a series of holding flanges jointly referred to by numeral 34 which are generally of a wedge shape, the top surface 36 of these flanges 34 generally being parallel to the top wall 26 of the sealing ring seat 24.

A sealing ring 38 has a groove 40 extending circularly around it. This groove 40 divides the upper portion of ring 38 into two parts—ribs 42 and 44. The outer rib 42 is of a generally rectangular shape when viewed in cross-section. The thickness of the rib 42 as measured between its inside and outside walls 46 and 48 respectively and the depth of groove 40 are generally chosen such that the outside dimensions of rib 42 are slightly smaller than the interior dimensions of channel 30. Thus when ring 38 is mated to sealing ring seat 24 one or more of the following surfaces forms a water tight seal between these components, that is, walls 46 and 48 of rib 42 fit against the inside of walls 22 and 28 and/or the bottom 50 of wall 28 fits against the bottom of groove 40 and/or the top surface 52 of the rib 42 fits against the interior surface of top wall 26.

In the preferred embodiment of the sealing ring 38 shown in the figures, wall 48 is flared outward near its lower end (not separately numbered) forming a skirt 54 around the perimeter of the sealing ring 38. When the sealing ring 38 is fitted into sealing ring seat 24, skirt 54 fits against the uppermost portion of housing 18 between the point where external wall 22 meets housing 18 and the point of attachment of the top surface of holding flange 34. In this preferred embodiment the pressure of skirt 54 against flanges 34 biases the sealing ring 38 into a snug, water-tight seal with the sealing ring seat 24 via any one or all of the contact surfaces heretofore described.

On the inside surface of inner rib 44 are a plurality of flanges jointly designated by the numeral 56, having a generally curved surface and extending circularly around the interior opening (not separately numbered) of sealing ring 38. The diameter of a circle formed by the interior wall 58 of rib 44 is so constructed as to be smaller than the diameter of the circle formed by the interior wall 28 of seat 24. When ring 38 is mated with seat 24, inner rib 44 fits within the circular cavity formed by inner wall 28. However, since the diameter of the rib 44 is smaller, a space 60 is left between rib 44 and wall 28.

A section of pipe shown in phantom lines in FIG. 1 is inserted into sealing ring 38 and flanges 56 abut against the pipe forming a water-tight seal between the pipe and sealing ring 38. However, when a pipe is inserted into the sealing ring 38 at some angle slightly different than that perpendicular to the top wall 26, the space 60 between rib 48 and wall 28 allows the sealing ring 38 to flex slightly to maintain flanges 56 against the surface of the pipe allowing sealing ring 38 to maintain its water-tight seal against the pipe and also its water-tight seal in sealing ring seat 24.

The herein described roof flashing structure can be used in a variety of different constructions; however, it is evisioned to be very beneficial in construction in areas wherein outdoor winter construction is difficult. During milder weather when the frame of a building is being constructed a nail or other marking device in placed in the roof deck 62. The roof flashing structure 10 is then placed on top of the roof deck 62, and the shingling or other protective material is applied to the top surface of the roof deck 62. When the weather turns inclement the inside of the structure is completed including the plumbing. At this time a hole 16 is simply cut in the roof deck 62 from the inside of the structure 10 using the marking device to locate its approximate placement. The vent or other pipe is then slid up through the hole 16 and through the sealing ring 38 in a smooth operation which is both time and labor saving and does not require any manual steps to be performed outside the building. Since a seal is instantly formed between the pipe and the roof flashing structure 10 no further operations or attention need be made to this construction procedure.

A further advantage of the instant roof flashing structure is derived by the physical construction of the sealing ring seat 24. When the pipe is inserted into the sealing ring 38, this ring is compressed between the pipe and the sealing ring seat. The elasticity of the sealing ring takes up some of this compression; however, a portion of the compression force is also transferred to the sealing ring seat. In prior known roof flashing structures, since the sealing ring fitted directly into a groove on the housing, this compression force could cause stress on the housing resulting in cracking of the housing. In the roof flashing structure herein described, the two essentially parallel walls 22 and 28 together with top wall 26 which is generally perpendicular to both of these walls, forms a unit having greater physical strength than the previous known roof flashing structures and is able to absorb the compression from sealing ring and not transfer it to the housing.

I claim:

1. A roof flashing structure used to form a seal between a roof and a pipe, extending through the roof, of the type wherein a generally flat plate having a centralized opening of a larger dimension than said pipe, and an upstanding tapered housing having an internal dimension larger than said pipe are integrally formed of a rigid material such that said housing extends upward from said plate and said centralized hole in said plate forms the lowermost opening in said housing, the improvement which comprises:

said housing having an annular retaining means extending around the uppermost periphery of said housing, said retaining means consisting of an interior wall and an exterior wall which are opposite to each other, said exterior wall being formed integrally with and forming the uppermost portion of said housing, a top wall connecting said interior and exterior walls, said walls forming a circular channel opening generally downward toward said plate;

a resilient, elastomeric sealing means, said sealing means having a groove extending circularly around the upper surface of said sealing means, and said groove dividing the upper portion of said sealing means into an outer rib and an inner rib of such dimension that when said sealing means is fitted into said retaining means said outer rib of said sealing means fits closely within said channel in said retaining means;

said inner rib of said sealing means having a plurality of sealing flanges extending circularly around said rib and projecting radially toward the center of said sealing means, said flanges each being independently capable of engaging with and forming a seal with said pipe.

2. A roof flashing structure of claim 1 wherein:

said housing has a plurality of holding means formed integrally on the interior of said housing proximal to said retaining means.

3. A roof flashing structure used to form a seal between a roof and a pipe, extending through the roof, of the type wherein a generally flat plate having a centralized opening of a larger dimension than said pipe, and an upstanding tapered housing having an internal dimension larger than said pipe are integrally formed of a rigid material such that said housing extends upward from said plate and said centralized hole in said plate forms the lowermost opening in said housing, the improvement which comprises:

said housing having an annular retaining means extending around the uppermost periphery of said housing, said retaining means consisting of an interior wall and an exterior wall which are opposite to each other, said exterior wall being formed integrally with and forming the uppermost portion of said housing, a top wall connecting said interior and exterior walls, said walls forming a circular channel opening generally downward toward said plate;

a resilient, elastomeric sealing means, said sealing means having a groove extending circularly around the upper surface of said sealing means, and said groove dividing the upper portion of said sealing means into an outer rib and an inner rib of such dimension that when said sealing means is fitted into said retaining means said outer rib of said sealing means fits closely within said channel in said retaining means;

said inner rib of said sealing means having a plurality of sealing flanges extending circularly around said rib and projecting radially toward the center of said sealing means, said flanges each being independently capable of engaging with and forming a seal with said pipe;

said holding means consists of a plurality of flanges projecting from the interior wall of said housing.

4. A roof flashing structure of claim 1 wherein:

said exterior wall and said interior wall of said retaining means are parallel to each other.

5. A roof flashing structure of claim 1 wherein:

the outer rib of said sealing means fits snugly into and seals tightly in said channel in said retaining means forming a water-tight seal between said sealing means and said retaining means.

6. A roof flashing structure of claim 1 wherein:

said housing has a plurality of holding means formed integrally on the interior of said housing proximal to said retaining means; and, said exterior wall and said interior wall of said retaining means are parallel to each other.

7. A roof flashing structure used to form a seal between a roof and a pipe extending through the roof, of the type wherein a generally flat plate having a centralized opening of a larger dimension that said pipe and an upstanding tapered housing having internal dimensions larger than said pipe are integrally formed of a rigid material such that said housing extends upward from said plate and said centralized hole in said plate forms the lowermost opening in said housing, the improvement which comprises:

said housing having an annular retaining means extending around the uppermost periphery of said housing;

said retaining means consisting of an interior wall and an exterior wall which are parallel to each other, said exterior wall being formed integrally with and forming the uppermost portion of said housing, a top wall connecting said interior and exterior walls and together said walls forming a circular channel opening generally downward toward said plate;

a plurality of holding means formed integrally on the interior of said housing proximal to the retaining means;

a resilient, elastomeric sealing means;

said sealing means having a groove extending circularly around the upper surface of said sealing means and said groove dividing the upper portion of said sealing means into an outer rib and an inner rib of such dimension that when said sealing means is fitted into said retaining means, said outer rib of said sealing means fits closely within said channel in said retaining means.

* * * * *